United States Patent [19]

Lichtenstein et al.

[11] 4,077,106

[45] Mar. 7, 1978

[54] PALLET MAKING ASSEMBLY

[75] Inventors: Arthur L. Lichtenstein, Fresno; Vincent Petruzzi, San Carlos, both of Calif.; William M. Anderson, Jr., Spring, Tex.

[73] Assignee: Betty A. Lichenstein, Fresno, Calif.

[21] Appl. No.: 779,023

[22] Filed: Apr. 13, 1977

[51] Int. Cl.[2] ..... B27M 3/00

[52] U.S. Cl. ..... 29/792; 29/772; 29/785; 227/152; 144/288 C

[58] Field of Search ..... 29/792, 772, 785; 144/2 C, 3 L, 7, 309 T, 288 R, 288 C; 108/51.1; 269/321 F; 227/152

[56] References Cited

U.S. PATENT DOCUMENTS

| | | | |
|---|---|---|---|
| 553,094 | 1/1896 | Becht | 144/2 C |
| 3,302,942 | 2/1967 | Holloman | 144/288 C |
| 3,968,560 | 7/1976 | Vial | 29/772 X |

*Primary Examiner*—Milton S. Mehr
*Attorney, Agent, or Firm*—William C. Babcock

[57] ABSTRACT

A base-supported rotatable frame assembly that defines four upwardly and inwardly extending side frames. A pressurized fluid-actuated mechanism intermittently rotates the frame assembly through first, second, third and fourth stations. Stringers are removably placed in fixed positions on a side frame when it is at the first station, and deck boards are placed in abutting contact with the stringers when the stringer-supporting side frame is at the second station. The deck boards and stringers are nailed together at the third station to provide a single face pallet, which pallet is removed when the supporting side frame moves to the fourth station. A second of the inventions may be used to transform the single face pallet to a double face pallet if desired.

6 Claims, 18 Drawing Figures

A'
A
B
B-1
B-2
C
C-1
D
F
S-1
S-2
S-3
S-4

PALLET MAKING ASSEMBLY

BACKGROUND OF THE INVENTION

1. Field of the Invention

Pallet-Making Assembly

2. Description of the Prior Art

Pallets are used in vast numbers in industry, both in the single face and double face forms. A single face pallet includes a number of spaced, parallel stringers having spaced, parallel first deck boards nailed to first sides thereof and normal relative thereto. A double face pallet is a single face pallet that has second deck boards nailed to second sides of the stringers.

A primary object in devising the present invention is to supply a compact, relatively inexpensive device that is operated by pressurized fluid to intermittently rotate through first, second, third and fourth stations for stringers and deck boards to be mounted thereon and nailed together to provide a finished single face pallet.

Another object of the invention is to furnish a pallet-making assembly which operates intermittently under the control of an operator, with the operator determining the rate at which finished single face pallets will be provided by the invention.

A further object of the present invention is to provide a pallet-making assembly of such structure and operation that a second pallet-making assembly may be positioned adjacent the first assembly whereby single face pallets delivered from the latter to the second assembly may be transformed on the second assembly to double face pallets, and with a single operator being so situated that he can nail deck boards to stringers on both the first and second assemblies as they intermittently rotate.

SUMMARY OF THE INVENTION

A pallet-making machine that includes a floor-supported base which rotatably supports a frame assembly having four upwardly and inwardly extending side frames, each of which successively rotates through first, second, third and third and fourth stations. Intermittent rotation of the frame assembly is achieved by a pressurized fluid-actuated mechanism that is controlled by an operator. The pressurized fluid may be air, hydraulic fluid, or a combination thereof.

When a frame assembly is at a first station, an operator places a number of pre-cut stringers in predetermined spaced positions thereon, with deck boards being placed in abutting contact with the stringers when the latter are at the second station. The stringers and boards are nailed together at the third station to form a finished single face pallet, with the latter being removed from the assembly when the pallet moves to the fourth station. Each intermittent rotation of the frame assembly is accompanied by additional stringers and boards which are placed thereon, a nailing operation carried out, and a finished single face pallet removed from the assembly.

By placing a second pallet-making assembly adjacent the first assembly, the single face pallets may be successively placed on the second assembly to be transformed into double face pallets by nailing second deck boards to the stringers opposite the first deck boards.

DESCRIPTION OF THE PREFERRED EMBODIMENTS

Figure 1:
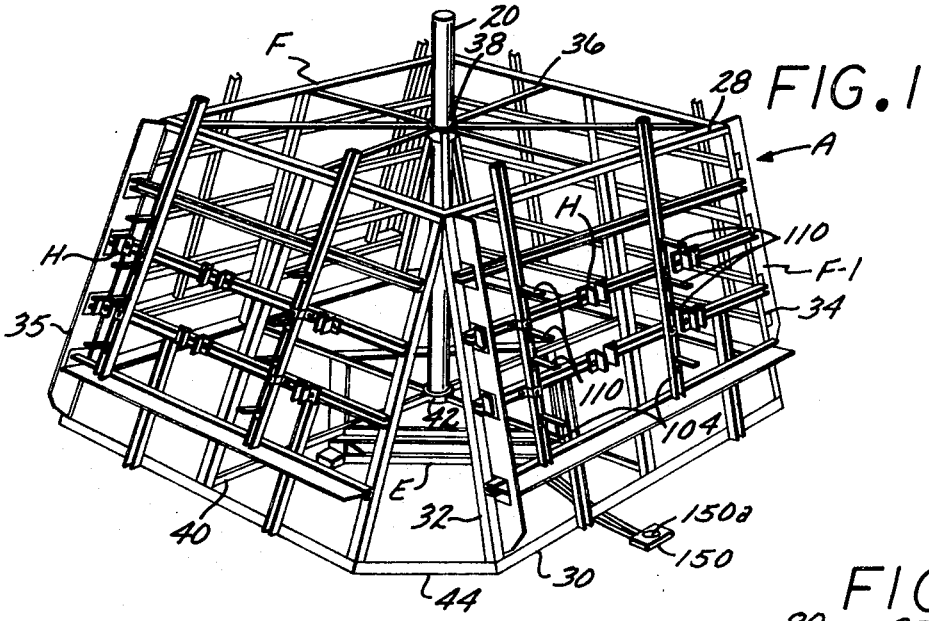
FIG. 1 is a perspective view of the pallet-making assembly.

The first of the inventions A shown in FIG. 1 may be used to produce single face pallets B from pre-cut wood stringers B-1 and pre-cut boards B-2 by a number of human operators C, one of whom C-1 acts as a nailer. The sequence of steps used in forming a single face pallet B is diagrammatically illustrated in FIGS. 9—12. A second of the inventions A′ that is identical to the first of the inventions may be used with the latter to transform single face pallets B to double face pallets D by the sequence of steps shown in FIGS. 12—16. Inasmuch as the first and second inventions A and A′ are identical in structure and operation, only the first invention will be described in detail.

Figure 2:
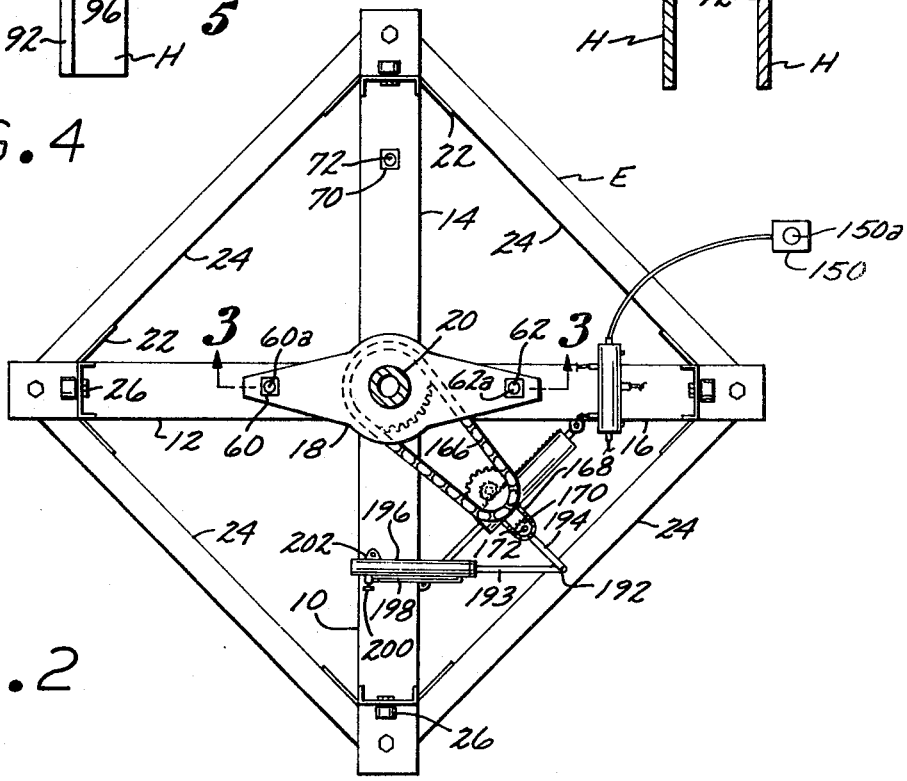
FIG. 2 is a top plan view of the base and the pressurized fluid-actuated mechanism for intermittently rotating the frame assembly.

The first invention A includes a base E which is illustrated in FIG. 2 as being defined by first, second, third, and fourth arms 10, 12, 14 and 16 so arranged as to define a cross, with the arms merging into a center portion 18 which supports an upright 20 of circular transverse cross section. Clips 22 are secured to the free ends of the arms 10, 12, 14 and 16 from which side pieces 24 extend therebetween and affixed thereto by conventional fasteners 26.

The upright 20 serves to rotatably support a frame assembly F that defines four identical side frames F-1, which are illustrated in FIG. 1 as being square in shape. Each side frame F-1 extends upwardly and inwardly as may also be seen in FIG. 1. Each side frame F-1 is defined by an upper horizontal cross piece 28, lower cross piece 30, and first and second upwardly extending end pieces 32 and 34. A rib 35 extends outwardly from each of the first end pieces 32, the purpose of which rib will later be explained.

Eight upper substantially horizontal arms 36 extend inwardly from the upper cross piece 28, as may be seen in FIG. 1, and on their inner ends are secured to an upper cylindrical bearing 38 that rotatably engages upright 20. Four lower substantially horizontal arms 40 extend inwardly from the centers of the lower cross pieces 30, and on their inner ends are secured to a lower cylindrical bearing 42 that rotatably engages the upright 20. Adjacent the lower ends of the first and second end pieces 32 and 34 are connected by horizontal frame members 44.

Figure 3:
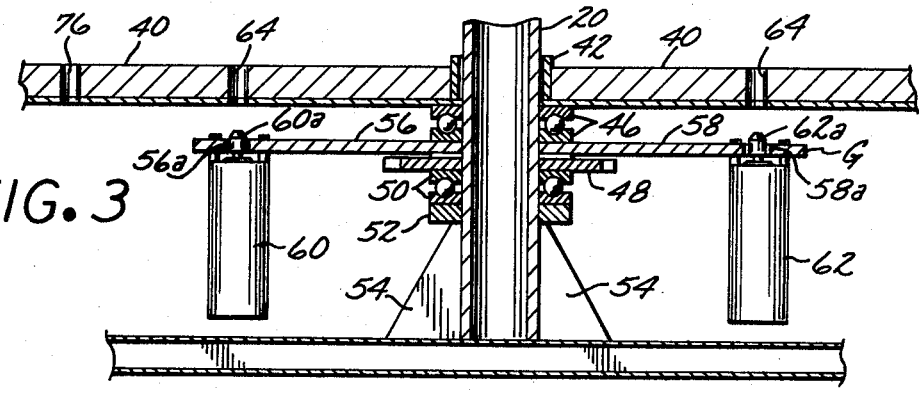
FIG. 3 is a combined side elevational and vertical cross-sectional view of the lower portion of the frame assembly and the actuator.

Lower bearing 42 rests on a first ball bearing assembly 46 that rotatably engages upright 20. First ball bearing assembly 46 is supported on an actuator G that has a driven gear 48 secured thereto, with both the actuator and driven gear being rotatable on upright 20. Driven gear 48 rests on a second ball bearing assembly 50 rotatably supported on upright 20. Second ball bearing assembly 50 is held at a fixed elevation on upright 20 by a plate 52 that is welded or otherwise secured to the upright. Gusset plates 54 are welded to the lower portion of upright 20 and first, second, third and fourth arms 10, 12 14 and 16 for reinforcing purposes as may be seen in FIG. 3.

Actuator G includes first and second axially aligned oppositely extending legs 56 and 58 that have first and second air cylinders 60 and 62 supported in depending positions from the outer ends thereof. First and second cylinders 60 and 62 have first and second plungers 60*a* and 62*a* slidably moveable therein. When pressurized air is discharged into the lower interior portions of cylinders 60 and 62 the plungers 60*a* and 62*a* are moved upwardly through first and second bores 56*a* and 58*a* in legs 56 and 58 to engage vertical bores 64 in lower arms 40. Pressurized air is discharged into the lower portions of first and second air cylinders 60 and 62 through a flexible conduit 66. When pressurized air is discharged into the upper interior portions of air cylinders 60 and 62, through a flexible conduit 68 the first and second plungers 60*a* and 62*a* move downwardly to the second positions shown in FIG. 3 as pressurized air in the lower interior portions of the cylinders escapes therefrom through conduit 66.

Figure 8:
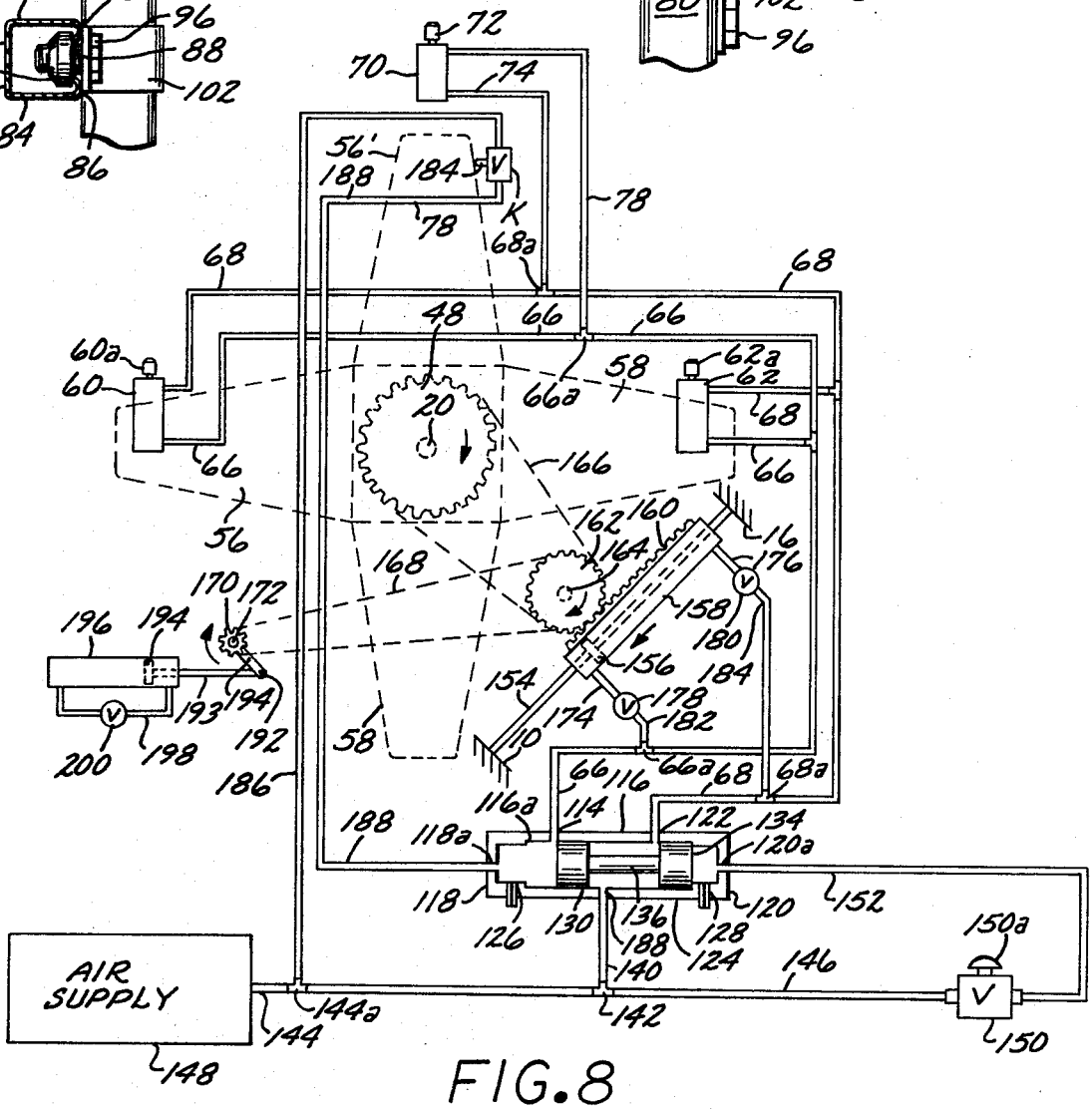
FIG. 8 is a diagrammatic view of the pressurized fluid-actuated mechanism used in intermittently rotating the frame assembly relative to first, second, third, and fourth stations.

A third vertically disposed air cylinder 70 is mounted on the third arm 14 of base D, as shown in FIG. 2, and has a third vertically movable plunger 72 slidably mounted therein. When pressurized air is discharged into the lower interior portion of third air cylinder 70 through a conduit 84, third plunger 72 is moved upwardly to engage a vertical bore 76 in a lower arm 40. When third plunger 72 is in engagement with a bore 76, the frame assembly F and actuator G rotate as an integral unit on upright 20. Downward movement of third plunger 72 is attained by discharging pressurized air into the upper interior portion of third air cylinder 70 through a conduit 78 and concurrent discharge of air from the lower interior portion of the cylinder through conduit 74. When third plunger 72 is moved downwardly out of engagement with bore 76, actuator G may rotate independently of frame assembly F. Conduit 74 is connected to conduit 68 by a tee fitting 68*a*. The conduit 78 is connected to conduit 66 by a tee fitting 66*a* as shown in FIG. 8.

Figure 6:
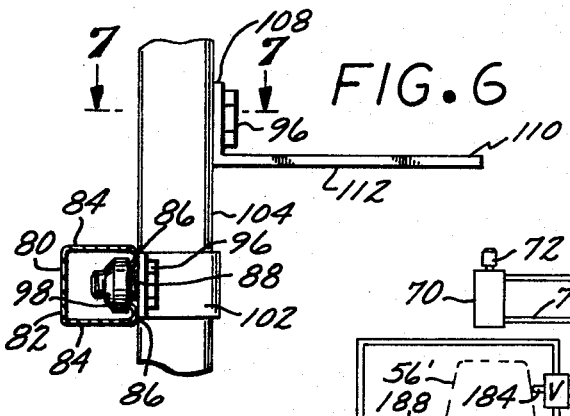
FIG. 6 is a fragmentary side elevational view of a side frame illustrating a vertical member adjustably supported from a cross member, with the vertical member adjustably supporting a board support.

Each side frame F-1, as may be seen in FIG. 1 has a number of horizontal, vertically spaced cross members 80 extending between the first and second end pieces 32 and 34. Each cross member 80 is of channel-shaped transverse cross section and is defined by a web 82, a pair of flanges 84, and a pair of lips 86 on the outer ends of the flanges that extend inwardly towards one another to form a longitudinal slot 88 therebetween, as shown in FIG. 6.

Figure 4:
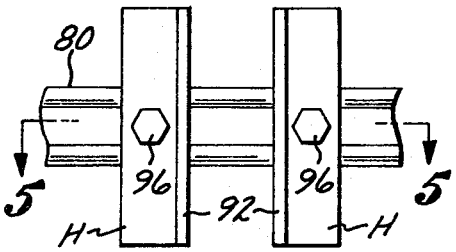
FIG. 4 is a fragmentary first elevational view of a portion of a side frame illustrating a cross member that adjustably supports a pair of guides between which a stringer may be disposed on the frame assembly to extend upwardly and inwardly relative thereto.
Figure 5:
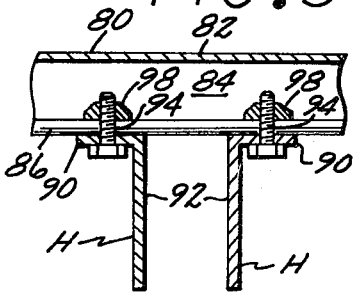
FIG. 5 is a horizontal cross-sectional view of the pair of guides taken on the line 5—5 of FIG. 4.

A number of L-shaped guides H are provided. Each guide H includes first and second normally disposed legs 90 and 92, with first leg 90 having an opening 94 therein. Each guide H has a bolt 96 that extends through opening 94 and slot 88 into the interior of a cross member 80 to be engaged by a nut 98. By tightening the bolts 96, the guides H may be horizontally adjusted as pairs on cross members 80 as shown in FIGS. 4 and 5, with the second legs 92 extending outwardly and defining a space 100 therebetween in which one of the stringers B-1 may be disposed when the lower end of the latter rests on lower cross member 30.

When the pairs of guides H and single guides H are vertically aligned the side frame F-1 of which they form a part may removably support a number of laterally spaced, upwardly extending stringers B-1 in the spaces 100. The space 100 between each pair of guides H is variable and thus stringers B-1 of different widths may be supported on the side frames F-1 as the latter revolve intermittently about upright 201.

Figure 7:
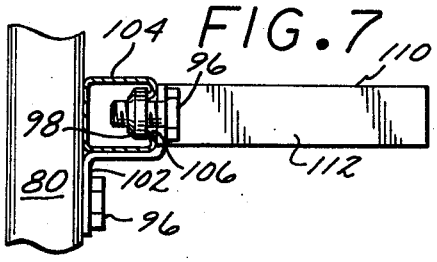
FIG. 7 is a combined horizontal cross-sectional and top plan view of the structure shown in FIG. 6, taken on the line 7—7 of said figure.

A number of L-shaped clips 102 are also adjustably supported from cross members 80 by bolts 96, and the clips 102 serving to support two or more upwardly extending elongate members 104. Members 104 are of the same transverse cross section as the cross members 80. The elongate members 104 as may be seen in FIG. 7 have longitudinal grooves 106 in which bolts 96 with associated nuts 98 are adjustably movable. Each bolt 96 that engages one of the grooves 106 extends through an opening (not shown) in a first leg 108 of an L-shaped board support 110. The second leg 112 of each board support 110 extends outwardly and in length is at least as long as the thickness of a double face pallet D.

From the above description and the view of the first invention A shown in FIG. 1, it will be seen that each side frame F-1 is adapted to removably support a number of horizontally spaced upwardly extending stringers B-1 thereon by use of guides H, and a number of boards B-1 overlying the stringers in vertically spaced relationship whereby they may be nailed to the stringers.

The frame assembly F rotates intermittently through first, second and third stations S-1, S-2 and S-3 to return to the first station as shown in FIGS. 9 to 12 inclusive. The direction of rotation of frame assembly F is indicated by arrows in FIGS. 9–12. Stringers B-1 are placed on a side frame F-1 when that particular side frame is at first station S-1. Boards B-1 are placed on side frames F-1 when it has moved to second station S-2. The stringers B-1 are nailed to boards B-1 at third station S-3 to form single face pallet B. At fourth station S-4 the finished single face pallet B is removed from the first invention A and used as such or subsequently transformed to a double face pallet D by use of a second invention A'. The frame assembly F then rotates to return the side frame F-1 from which the single face pallet was removed to first station S-1 where the above described operation is repeated.

It will be seen that each time a side frame F moves to first station S-1 stringers B-1 are placed thereon and boards B-1 as it thereafter moves to second station S-2. Intermittent rotation of frame assembly F as above described may be achieved by the mechanism J shown diagrammatically in FIG. 8.

Conduit 66 is connected to a first port 114 of a two position spool type valve 116 shown in FIG. 8 that has first and second ends 118 and 120 through which longitudinal passages 118*a* and 120*a* extend. The conduit 68 is connected to a second port 122 in the housing 124 of valve 116. Housing 124 has first and second air discharge ports 126 and 128 therein as shown in FIG. 8. Housing 124 has an elongate interior in which a spool type valve member 130 is slidably and sealingly movable. Valve member 130 includes first and second longitudinally spaced valve bodies 132 and 134 that have a rod 136 extending therebetween.

A third port 138 is provided in substantially the center of housing 124 and has a conduit 140 extending therefrom to a tee fitting 142 that is connected to conduits 144 and 146. Conduit 144 is connected to a conventional source of pressurized air 148. The conduit 146 extends to a manually operated, normally closed, spring-loaded valve 150, preferably of a type that may be actuated by the foot of an operator O. Valve 150 is connected to a conduit 152 that is connected to second passage 120*a*. When actuator 150*a* of valve 150 is moved from its normally closed position to a second position, air under pressure flows from conduit 144 to conduit 146. The conduit 144 has a tee fitting 144*a* therein that is connected to conduit 74. The conduit 76 is connected to passage 118*a* as shown in FIG. 8.

A horizontal rod 154 extends angularly between the first and fourth legs 10 and 16 of base E as shown in FIGS. 2 and 8, and is secured thereto by conventional means. The rod 154 has a member 156 secured thereto that acts as a piston. The member 156 is slidingly and sealingly movable in an elongate cylinder 158 that supports a longitudinally extending toothed rack 160.

Rack 160 is in engagement with one of three gears 162 that rotate in unison on a vertical shaft 164 secured to base E by conventional means (not shown). A second of the gears 162 is connected by an endless chain belt 166 to driven gear 48.

A third one of the gears 162 is connected by an endless chain belt 168 to a gear 170 that is secured to a vertical shaft 172 that rotates in a fixed position relative to base E on bearing means of a conventional nature (not shown). Flexible conduits 174 and 176 are connected to the interior end portions of the cylinder 158, with the conduits extending to manually adjustable throttling valves 178 and 180 as shown in FIG. 8. Valves 178 and 180 are connected by conduits 182 and 184 to tee fittings 66*a* and 68*a* in conduits 66 and 68.

Initiation of a ninety degree rotation of frame assembly F and side frames F-1 from one station to the next of the stations S-1 to S-4 is achieved by an operator 0 momentarily pressing actuating 150*a* to open valve 150 to allow pressurized air to move valve member 130 from a first position as illustrated in FIG. 8 to a second position in which valve member 132 contacts stop 116*a*. During the time that valve member 130 is in the first position pressurized air flows through conduit 144, tee 142, conduit 140, valve 130, discharge port 122, to conduit 168.

Pressurizing air flows from conduit 68 through tee 68*a* to conduit 74 and third cylinder 70 to maintain plunger 72 in an upwardly disposed position in engagement with one of the openings 64 on an arm 40. The frame F when plunger 74 is so disposed is locked in a non-rotatable position relative to base E. Pressurized air also flows from conduit 74 to the upper interior portions of first and second air cylinders 60 and 62 to maintain first and second plungers 60*a* and 62*a* in downwardly disposed positions out of engagement with openings 64. When frame F is locked to base E as above described the nailing of stringers B-1 to boards B-2 can be carried out without the frame F rotating relative to base E. Pressurized air discharging into the interior of valve 116 does not tend to move valve member 130 as the pressurized air exerts equal and opposite forces on the adjacent faces of first and second vavle bodies 132 and 134. It will be noted that when valve member 130 is in the first position air may discharge from conduit 66 to valve 116 and then through openings 126 to the ambient atmosphere. When valve member 130 is in the first position pressurized air is free to flow from tee 68*a*, conduit 184, valve 180, and conduit 176 to the upper interior of cylinder 158.

When an operator O momentarily moves actuator 150*a* towards valve 150, pressurized air momentarily flows to valve 116 to move valve member 130 to a second position where it contacts stop 116*a*. Pressurized air may now flow from conduit 68, valve 116 and opening 128 to the ambient atmosphere. Pressurized air now flows from valve 116 into conduit 66 and first and second cylinders 60 and 62 to move plungers 60*a* and 62*a* upwardly into engagement with openings 64 in arms 40 of frame F to lock the latter to actuator G. Concurrently pressurized air flows to third cylinder 70 through conduit 78 to move third plunger 72 downwardly out of engagement with an opening 64 of an arm 40 to permit frame F to rotate relative to base E. Pressurized air now flows through tee 66*a*, conduit 182, valve 178 and conduit 174 into cylinder 158 to cause the latter and rack 160 to move in the direction of the arrow shown in FIG. 8. The gears 162 are rotated clockwise as viewed in FIG. 8, as rack 160 moves in the direction indicated by the arrow, with both the belts 166 and 168 being driven by second and third gears 162.

The driving of belt 166 results in concurrent rotation of gear 48, actuator G and frame assembly F. Rotation of actuator G will continue until first and second arms 56 and 58 have rotated to the position 56′ and 58′ illustrated in FIG. 8. When first arm 56 rotates to position 56′ it contacts spring-loaded actuator 184 of valve K to momentarily open the latter for pressurized air to flow through conduit 188 to valve 116 to move valve member 130 to the first position previously described. With valve member 130 in the first position, pressurized air will flow to first and second air cylinders 60 and 62 to retract first and second plungers 60*a* and 62*a*, and also flow to third cylinder 70 to move third plunger 72 into engagement with one of the openings 64. Frame assembly F is now temporarily locked to base E and a nailing operation can be carried out with the frame assembly in a stationary position. Pressurized air flows from conduit 68, tee 68*a*, conduit 184, valve 180, conduit 176 into cylinder 158 to return the latter, rack 160 and actuator G to the position shown in FIG. 8. Discharge openings 126 and 128 are of smaller transverse cross sectional area than that of the interiors of conduits 188 and 152, and as a result pressurized air is discharged into valve 116 at a faster rate than it discharges therefrom, with a consequent build up in pressure sufficient to move valve member 130 between first and second positions. Valves 178 and 180 may be adjusted to regulate the rate at which pressurized air flows into and out of cylinder 158 and the rate at which frame assembly F is rotated between stations S-1 to S-4.

Pressurized air operated devices tend to be jerky in operation. Smoothness in operation of the present air operated invention is attained by belt 168, driving gear 170 and shaft 172. An arm 190 is secured to shaft 172 and projects outwardly therefrom. A pin 192 pivotally connects the free end of arm 190 to a rod 193 secured to a piston 194 that is longitudinally movable in a cylinder 196 filled with hydraulic fluid (not shown). A by-pass line 198 in which a throttling valve 200 is disposed connects opposite interior ends of cylinder 196. As belt 168 is driven piston 194 moves longitudinally relative to cylinder 196 and forces hydraulic fluid through the by-pass line 198 and valve 200. Cylinder 196 is pivotally supported on first leg 10 by a lug and pin connection 202 as shown in FIG. 2. The rate of flow of hydraulic fluid through line 198 from one side of piston 194 in cylinder 196 to the opposite side thereof is controlled by manual adjustment of valve 200. Thus, valve 200 serves as an adjustable means to dampen the sodden actuation of air cylinder 158, rack 160, gears 162, belt 166, gear 48, actuator G and frame assembly F as valve member 130 moves between first and second positions.

Figures 9, 10, 11, 12, 13, 14, 15, 16:
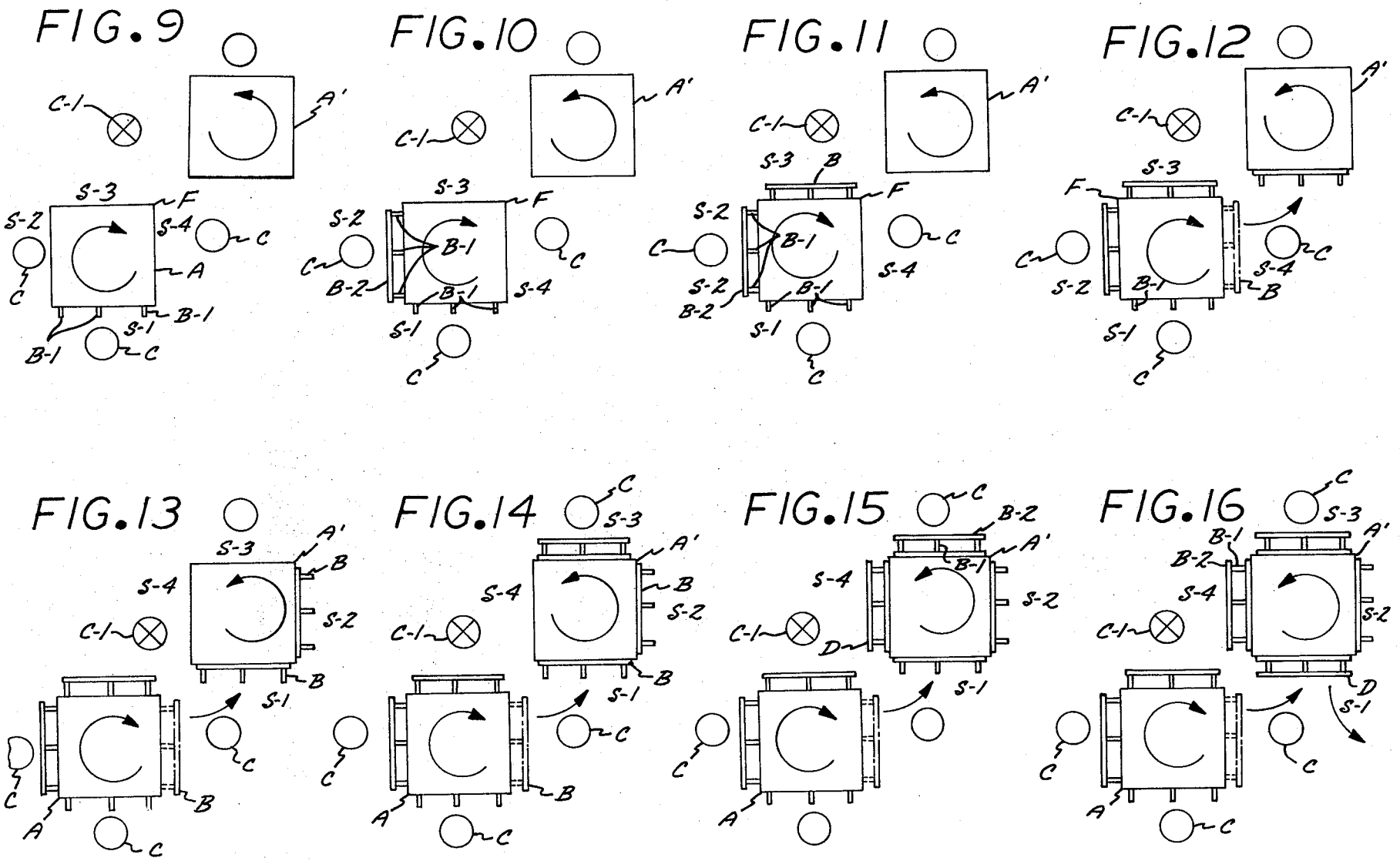
FIGS. 9 to 12 are diagrammatic views of the positioning of the frame assembly as stringers and boards are successively placed thereon and nailed together to form single face pallets that are removed from the frame assembly at the fourth station.
FIGS. 13 to 16 are diagrammatic views of the positioning of a second frame assembly as single face pallets that have been placed thereon and transformed to double face pallets.
Figure 17:
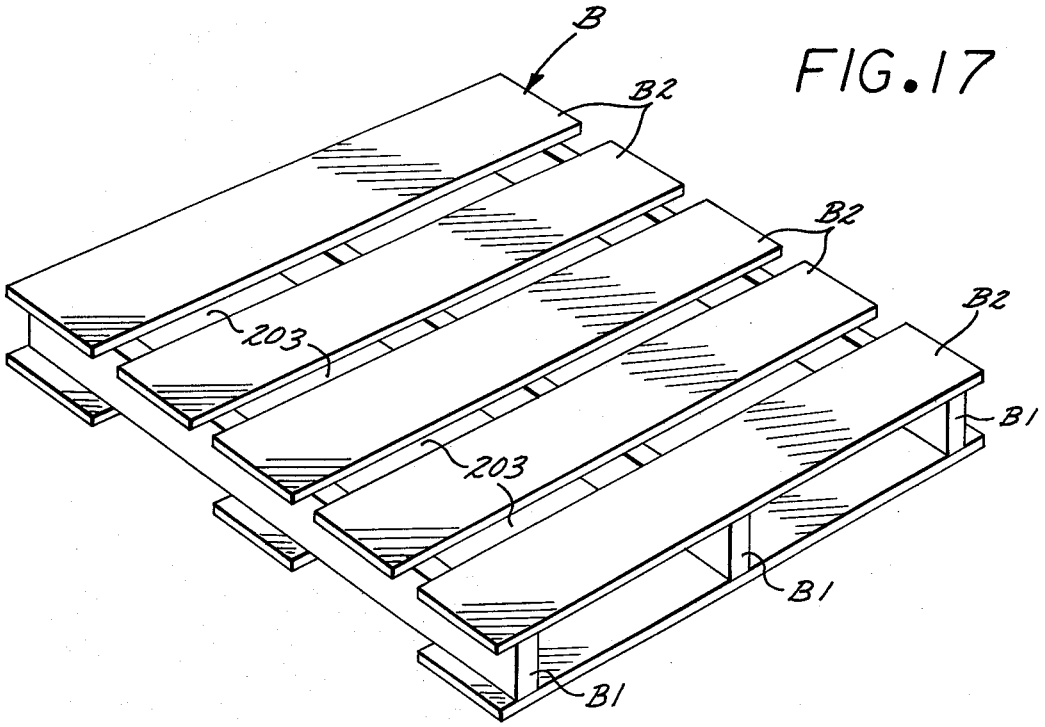
FIG. 17 is a perspective view of a single face pallet formed by the frame assembly formed by the frame assembly illustrated in FIG. 1.
Figure 18:
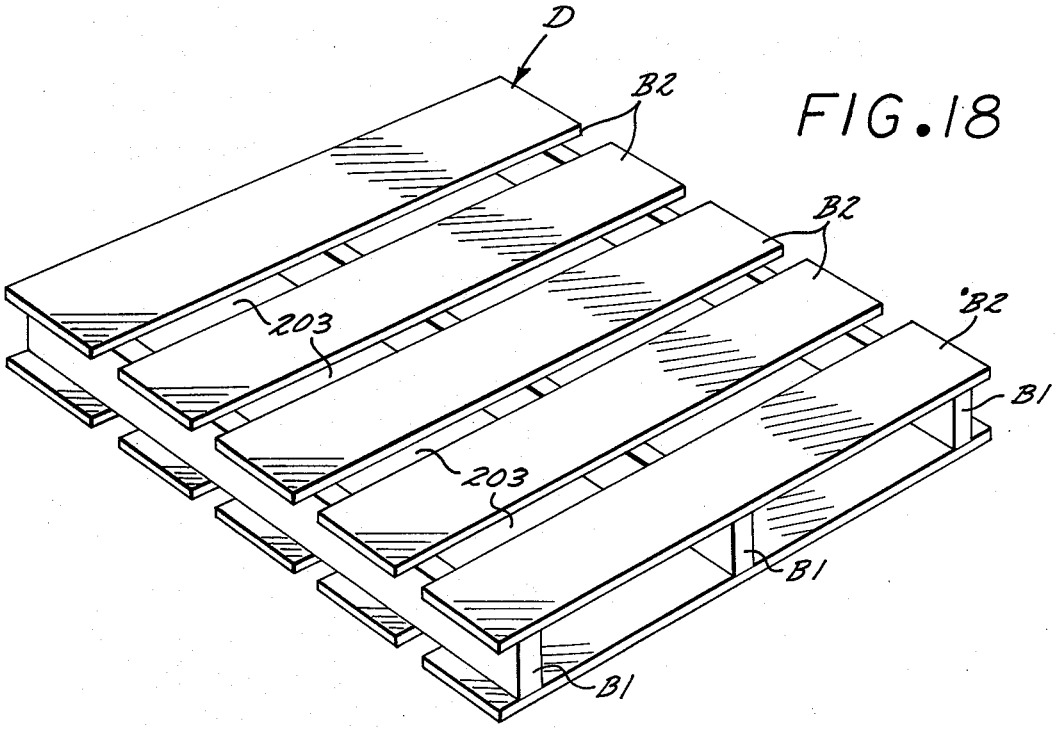
FIG. 18 is a perspective view of a double face pallet formed by a second of the frame assemblies illustrated in FIG. 1.

The single face pellet B as shown in FIG. 17 has elongate spaces 202 between the boards B-2 thereof. In FIG. 12 a single face pallet B is shown as being removed at station S-4 of the first invention A and mounted on second invention A′ by spaces 202 being engaged by board supports 110 of the second invention, with the boards B-2 of the singleface pallet disposed inwardly and stringers B-1 outwardly. Second invention A′ may be independently controlled by an operator O or actuated concurrently with first invention A. In FIGS. 14 and 15 it will be seen that additional pallets B have been mounted on second invention A′ that rotates in a direction opposite to that of first invention A. When pallet B has traveled to station S-3 of second inventon A′ as shown in FIG. 15, second set of boards B-2 are mounted on supports 110 in abutting contact with stringers B-1, and the second set of boards being nailed to the stringers by operator C-1 at station S-4 to form a double face pallet D. The double face pallets D are removed from second invention A′ when the double face pallet moves to station S-1, and prior to an operator C moving a single face pallet B to second invention A′ to occupy the space just vacated by a double face pallet D. The positions of the operators C and nailer C-1 in FIGS. 9–16 is merely illustrative and is not to be considered mandatory.

Although the invention has been illustrated and described as being pneumatically operated, it will be apparent that it may also be powered by mechanical means as well as hand-operated. A novel support for the pallets has been described, but may also be apparent that various flat surfaces may be used for the purpose in both vertical and horizontal positions.

The use and operation of the invention A is making single face pallets B that may be sold as such, or subsequently transformed to double face pallets D on second invention A′ has been explained previously in detail and need not be repeated.

We claim:

1. A first pallet-making assembly on which a plurality of spaced stringers and first deck boards are successively positioned to be nailed together to provide single face pallets, which assembly includes:

a. a base that has a center portion from which first, second, third and fourth elongate portions extend outwardly, said elongate portions being equally spaced from one another;

b. an upright of circular transverse cross section secured to said center portion;

c. a frame assembly that includes four side frames that extend upwardly and inwardly, each of which side frames include first and second end pieces and upper and lower horizontal cross pieces, upper and lower bearings rotatably supported at fixed positions on said upright, a plurality of upper and spaced arms that radiate from said upper bearing and are secured to said upper cross pieces, four equally spaced substantially horizontal lower arms that extend outwardly from said lower bearing to the centers of said lower cross pieces, and a plurality of vertically spaced elongate cross members that extend between said first and second end pieces;

d. first means adjustably supported from each of said side frames for removably holding a plurality of said stringers in fixed positions on said side frames;

e. second means adjustably supported from each of said side frames for removably holding a plurality of said boards in parallel spaced relationship outwardly from said stringers and normal thereto; and f. pressurized fluid operated power means connected to a source of pressurized fluid and controlled by manually actuatable means for intermittently rotating said frame assembly for each of said side frames to sequentially occupy first, second, third and fourth equally spaced stations, a plurality of said stringers being placed on each of said side frames to engage said first means when said side frame is at said first station, a plurality of said boards being placed on said stringer bearing side frame to engage said second means when said stringer bearing side frame is at said second station, said stringers and boards being nailed together to define a single face pallet when said side frame bearing the same is at said third station, and said single face pallet being removed from said side frame when said side frame is at said fourth station.

2. A first pallet making assembly as defined in claim 1 in which said first means includes:

g. a plurality of parallel, vertically spaced, cross members that extend between said first and second end pieces of each of said side frames; and h. a plurality of guides adjustably positionable on each of said cross members, said guides when disposed in vertically aligned sets on said cross members capable of supporting a plurality of said stringers in upwardly and inwardly extending positions when said stringers rest on said lower cross piece.

3. A first pallet-making assembly as defined in claim 2 wherein said second means includes:

i. a plurality of horizontally spaced, upwardly extending elongate members;

j. first bolt means for adjustably supporting said elongate members in desired horizontal spacing from said plurality of cross members;

k. a plurality of board supports; and l. second bolt means for adjustably supporting said board supports in horizontally aligned sets to permit said boards to rest thereon outwardly disposed from said stringers.

4. A first pallet-making assembly as defined in claim 3 wherein said pressurized fluid-operated power means includes:

m. an actuator rotatably supported on said upright below said lower arms of said frame assembly, said actuator including at least a first arm that is vertically aligned with a lower arm of said frame assembly when said actuator is in a first position, with said pressurized fluid-operated power means rotating said actuator ninety degrees to a second position when said fluid-operated power means is energized by said manually acceptable means and then returning said actuator to said first position;

n. first pressurized fluid-operated means on said arm of said actuator that removably engages said lower arm of said frame assembly above said actuator when said actuator rotates from said first to said second position, and disengages from said lower arm of said frame assembly at said second position to permit said actuator to return to said first position.

5. A first pallet-making assembly as defined in claim 4 wherein said pressurized fluid-operated power means also includes:

o. second pressurized fluid-operated means on said said base that engage one of said lower arms of said frame assembly after said actuator has rotated said frame assembly sufficiently for said actuator to occupy said second position, with said second pressurized fluid-operated means when in engagement with said lower arm of said frame assembly preventing said frame assembly from rotating relative to said base, and with said second pressurized fluid-operated means remaining in engagement with said lower arm of said frame assembly until said actuator again starts to move from said first position to said second position.

6. A first pallet-making assembly as defined in claim 1 in combination with a second of said pallet-making assemblies disposed adjacent thereto, with said single face pallets as completed on said first pallet-making assembly being transferred to said second pallet-making assembly to be transformed into double face pallets.

* * * * *

UNITED STATES PATENT OFFICE

CERTIFICATE OF CORRECTION

Patent No. 4,077,106 Dated March 7, 1978

Inventor(s) WILLIAM M. ANDERSON, Jr.
ARTHUR L. LICHTENSTEIN, VINCENT PETRUZZI

It is certified that error appears in the above-identified patent and that said Letters Patent are hereby corrected as shown below:
Delete designation of assignee from "Betty A. Lichenstein, Fresno, Calif." to --- part interest Betty A. Lichtenstein, Fresno, Calif. ---.

Add Claim 7 as follows:

--- 7. A first pallet-making assembly on which a plurality of spaced stringers and first deck boards are successively positioned to be nailed together to provide single face pallets, which assembly includes:

a. a base that has a center portion from which first, second, third and fourth elongate portions extend outwardly, said elongate portions being equally spaced from one another;

b. an upright of circular transverse cross section secured to said center portion;

c. a frame assembly that includes four side frames that extend upwardly and inwardly, each of which side frames include first and second end pieces and upper and lower horizontal cross pieces, upper and lower bearings rotatably supported at fixed positions on said upright, a plurality of upper spaced arms that radiate from said upper bearing and are secured to said upper cross pieces, four equally spaced substantially horizontal lower arms that extend outwardly from said lower bearing to the centers of said lower cross pieces, and a plurality of vertically spaced elongate cross members that extend between said first and second end pieces;

d. first means adjustably supported from each of said side frames for removably holding a plurality of said stringers in fixed positions on said side frames;

e. second means adjustably supported from each of said side frames for removably holding a plurality of said boards in parallel spaced relationship outwardly from said

UNITED STATES PATENT OFFICE
CERTIFICATE OF CORRECTION

Patent No. 4,077,106 Dated March 7, 1978

Inventor(s) WILLIAM M. ANDERSON, Jr.
ARTHUR L. LICHTENSTEIN, VINCENT PETRUZZI

It is certified that error appears in the above-identified patent and that said Letters Patent are hereby corrected as shown below:

stringers and normal thereto, and said frame assembly capable of being intermittently rotated for each of said side frames to sequentially occupy first, second, third and fourth equally spaced stations, a plurality of said stringers being placed on each of said side frames to engage said first means when said side frame is at said first station, a plurality of said boards being placed on said stringer bearing side frame to engage said second means when said stringer bearing side frame is at said second station, said stringers and boards being nailed together to define a single face pallet when said side frame bearing the same is at said third station, and said single face pallet being removed from said side frame when said side frame is at --- said fourth station.

On the title page below the Abstract, "6 Claims" should read --7 Claims--.

Signed and Sealed this

*Fifteenth* Day of *August 1978*

[SEAL]

*Attest:*

RUTH C. MASON
*Attesting Officer*

DONALD W. BANNER
*Commissioner of Patents and Trademarks*